United States Patent [19]

Haas, Jr.

[11] 4,337,283

[45] Jun. 29, 1982

[54] SYNTHETIC TURF PLAYING SURFACE WITH RESILIENT TOP-DRESSING

[76] Inventor: Frederick T. Haas, Jr., 147 E. Oakridge Pk., Metairie, La. 70005

[21] Appl. No.: 186,344

[22] Filed: Sep. 11, 1980

[51] Int. Cl.[3] ..... A01N 3/00

[52] U.S. Cl. ..... 428/17; 273/29 R; 273/29 A; 428/96; 428/331

[58] Field of Search ..... 428/17, 96, 331; 273/29 R, 29 A

[56] References Cited

U.S. PATENT DOCUMENTS

| | | | |
|---|---|---|---|
| 2,054,527 | 6/1931 | Teague . | |
| 3,157,557 | 4/1961 | Palmer . | |
| 3,332,828 | 12/1965 | Faria et al. . | |
| 3,570,846 | 8/1968 | Weber et al. . | |
| 3,661,687 | 5/1972 | Spinney, Jr. et al. . | |
| 3,731,923 | 5/1973 | Greene . | |
| 3,740,303 | 6/1973 | Alderson et al. . | |
| 3,801,421 | 4/1974 | Allen | 428/17 |
| 3,900,656 | 8/1975 | Schmidt . | |
| 3,995,079 | 11/1976 | Haas, Jr. | 428/17 |
| 4,044,174 | 8/1977 | Hass | 428/17 |
| 4,044,179 | 8/1977 | Haas, Jr. . | |

FOREIGN PATENT DOCUMENTS

| | | |
|---|---|---|
| 1902921 | 9/1969 | Fed. Rep. of Germany . |
| 560067 | 9/1923 | France . |
| 2238805 | 2/1975 | France . |
| 401304 | 11/1933 | United Kingdom . |
| 1411623 | 10/1975 | United Kingdom . |

*Primary Examiner*—Marion McCamish

*Attorney, Agent, or Firm*—Schwartz, Jeffery, Schwaab, Mack, Blumenthal & Koch

[57] ABSTRACT

A playing surface for athletic games comprising a stable subsurface, a pile fabric resembling grass and a compacted top-dressing comprising a mixture of from 25 to 95 volume percent resilient particles and from 5 to 75 volume percent fine sand. The inventive surface is particularly suited for use as a playing field for contact sports such as football, rugby, soccer, field hockey, baseball and the like where players may fall or be knocked down on the playing surface. Preferred resilient materials include cork granules, natural or synthetic rubber particles, synthetic polymer beads and synthetic polymer foam particles.

29 Claims, 1 Drawing Figure

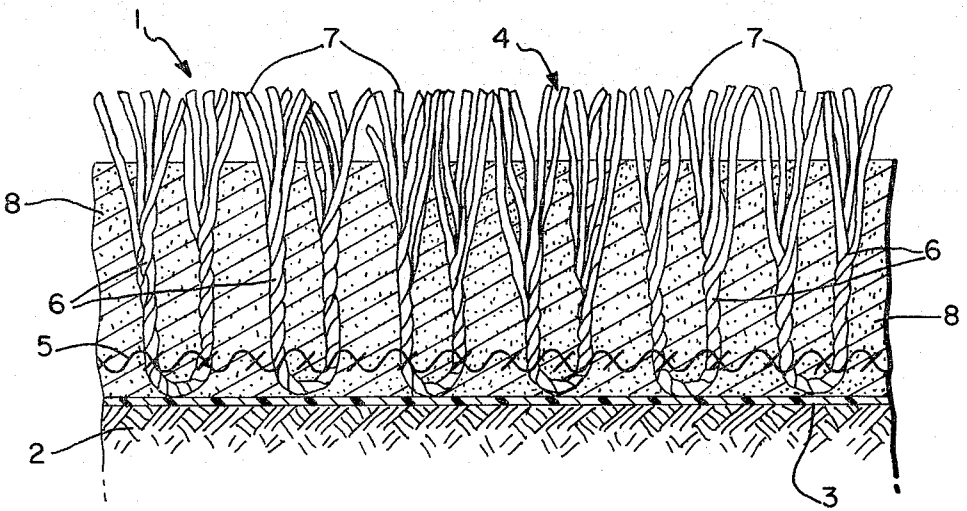
1
4
7
7
8
6
6
5
2
3
8

SYNTHETIC TURF PLAYING SURFACE WITH RESILIENT TOP-DRESSING

FIELD OF THE INVENTION

This invention relates to playing surfaces for athletic games. More particularly, this invention relates to syntheitc turf playing surfaces which closely duplicate the appearance and physical characteristics of natural turf playing surfaces. Specifically, this invention relates to a playing surface with a resilient, non-abrasive top-dressing which is especially suitable for use on playing fields for contact sports.

BACKGROUND OF THE INVENTION

A natural grass turf covering has traditionally been cultivated on most playing areas for athletic games. Grass is considered highly desirable both because it stabilizes the soil thereby limiting problems with mud or dust, and also because of its attractive appearance. However, maintainence of natural grass turf on athletic playing areas is very expensive and is practically impossible on areas subjected to continuous heavy usage.

In order to minimize the expense of maintaining athletic playing areas as well as increase the durability of the playing surfaces, attempts have been made to substitute synthetic turf for natural turf. The results of prior efforts have, however, left much to be desired. Particularly severe problems arise in the construction of fields for contact sports such as football, rugby, soccer, field hockey, baseball and the like.

In an effort to achieve some degree of resilience, many prior art synthetic turfs have incorporated an elastomeric foam underlay or backing similar to a carpet pad. Synthetic turfs with foam backing are typlified by the materials in Faria, U.S. Pat. No. 3,332,828 and Spinney, U.S. Pat. No. 3,661,687. Such turfs have an unnatural, springy or spongy feel which reduces the surefootedness of players running and making sharp turns thereon. The surface may be slippery due to graininess or the presence of moisture. Players falling on such surfaces may receive severe rug-burns. The degree to which such surfaces contribute to player injuries has been a matter of substantial controversy.

Top-dressed playing surfaces for athletic games are disclosed in my prior U.S. Pat. Nos. 3,995,079 and 4,044,179. The '079 patent discloses golf greens formed from a turf-like pile fabric top-dressed with non-compacting granular material such as granulated coal slag, crushed flint or crushed granite. Angular top-dressing materials of this type are very abrasive and may scrape the skin of a person falling on the surface. Moreover, such top-dressing materials generally are not readily available in all areas, and consequently, undesirable expense and difficulty may be encountered in installing such surfaces.

U.S. Pat. No. 4,044,179 shows a playing surface comprising a pile fabric with piles resembling grass disposed upon a firm, stable subsurface and top-dressed with sand containing a small amount of moisture modifying material. The sand top-dressing compacts to form a dense, hard layer. This surface is well suited for tennis courts and also can be used for other games. Surfaces of this type are not entirely satisfactory for fields for contact sports because the compaction of the top-dressing limits the shock absorbing ability of the surface and because the sand top-dressing is only slightly less abrasive than non-compacting angular particle dressings.

Playing surfaces have also been constructed with compacted sand top-dressings and resilient underpads as described in co-pending U.S. patent application Ser. No. 115,141 filed Jan. 24, 1980 now abandoned. These surfaces have outstanding shock absorbing character and provide a natural turf-like feel for players walking or running thereon. They are particularly well suited for ball control games such as golf, tennis, lawn bowling, cricket and the like. However, the abrasiviness of the compacted sand top-dressing remains a problem in contact sports where players not infrequently fall or are knocked down on the playing surface. Moreover, the use of a resilient underpad substantially increases the cost of the playing surface and simultaneously decreases the service life of the surface since the underpads deteriorate over time.

There remains a need for a highly durable, less expensive synthetic turf playing surface which closely simulates the appearance and physical character of natural turf without presenting an abrasive surface. There is a particular need for a synthetic turf playing surface which does not give the feeling of running or walking across a springy or spongy surface.

OBJECTS OF THE INVENTION

It is therefore an object of the present invention to provide a playing surface for athletic games which is particularly well adapted for use as a playing field for contact sports where players may fall or be knocked down on the playing surface.

A further object of the present invention is to provide a playing surface for athletic games which when used for contact sports provides good shock absorption.

Another object of the present invention is to provide a playing surface for athletic games which does not present a highly abrasive surface.

A further object of the present invention is to provide a playing surface for athletic games which is less expensive to construct and has a longer service life than surfaces with resilient underpads.

It is also an object of the present invention to provide a playing surface for athletic games which is top-dressed with readily available materials.

Another object of the invention is to provide a playing surface which is safer than prior art surfaces.

Another object of the present invention is to provide a playing surface for athletic games which is easier and less expensive to maintain than natural turf.

It is also an object of the present invention to provide a playing surface for athletic games which is more durable in use than natural turf.

A further object of the present invention is to provide a playing surface for athletic games which provides a natural footing for a player running or walking thereon.

SUMMARY OF THE INVENTION

These and other objects of the invention are achieved by providing a playing surface for athletic games comprising:

- a firm, stable subsurface;
- a pile fabric having a flexible backing and normally upstanding pile elements resembling grass;
- the length of said pile elements being substantially uniform and lying in the range from about ½ to about 2 inches; and a compacted top-dressing layer comprising a mixture of from 25 to 95% resilient particles and from 5 to 75% fine sand interspersed on the backing among the pile elements to a substantially uniform depth.

The combination of subsurface, pile fabric and top-dressing comprising resilient particles provides excellent shock absorption and a natural footing for players without presenting an abrasive surface. It is less expensive to construct than artificial turfs having resilient underpads and is more durable and easier to maintain than natural turf. The playing surface of the invention eliminates the feeling of walking or running on a springy or spongy surface which is encountered with conventional artificial turfs using foam underpads.

BRIEF DESCRIPTION OF THE DRAWING

The invention will be explained in further detail with reference to the accompanying drawing which is a sectional view through an athletic playing surface according to the present invention.

DETAILED DESCRIPTION OF PREFERRED EMBODIMENTS

The figure depicts a sectional view through a playing surface according to the present invention. Playing surface 1 starts with a firm, stable subsurface 2 upon which the remainder of the playing surface is constructed. A moisture barrier layer 3 is disposed over subsurface 2. A pile fabric 4 with generally upstanding pile elements resembling grass is positioned on top of moisture barrier 3. In the drawing, the pile fabric 4 is depicted as a woven fabric backing 5 through which a plurality of segments of multi-filament yarn 6 have been tufted to form the upstanding piles. At the free ends of the tufts, the individual filaments 7 can be seen. Among the pile elements on the backing there is a compacted layer of top-dressing 8 comprising a mixture of from 25 to 95% resilient particles and from 5 to 75% fine sand.

Subsurface 2 establishes the contour of the playing surface. In order to provide a good playing surface, the subsurface must be smooth. Subsurface 2 should be sufficiently compacted that it will not settle or shift after installation of the playing surface but will provide a firm, stable foundation for the playing surface. Subsurface 2 may consist of concrete or asphalt pavement, compacted clay, gravel rolled into ordinary dirt or any of a number of other firm materials. A four inch thick layer of traffic bond provides a particularly suitable subsurface. Adequate subsurface drainage should be provided. For most games, a flat, generally level surface is needed. A slight slope may be provided to facilitate surface drainage.

Moisture barrier layer 3 functions to reduce water penetration and heaving and to protect the surface from ground moisture. If the subsurface consists of concrete or asphalt pavement, moisture barrier layer 3 may be dispensed with. A suitable moisture barrier layer may be formed with polyethylene sheeting between 2 and 10 mils thick such as is sometimes used as a vapor barrier in pouring concrete. A 6 mil thick sheet has been found to produce excellent results. Another suitable material for the moisture barrier layer is commercial asbestos roofing felt between 30 and 100 pound weight, preferably about 70 pound weight.

The pile fabric 4 may be a tufted or knitted pile fabric or any other suitable construction. For reasons or cost as well as flexibility of design, a tufted fabric is generally preferred. The fabric backing may be any suitable woven, felted or extruded web. A particularly preferred backing is a woven polypropylene fabric having a weight of about 25 oz. per square yard. Tufted through the backing are segments of a multi-filament yarn made from $\frac{3}{8}$ gauge polypropylene ribbon 5 mils thick which is slit and twisted to form a plurality of thin filaments. Normally each strand of yarn will comprise from 20 to 50 or more individual filaments. In order to provide a pleasing natural appearance, the polypropylene is typically dyed a green color. Suitable color stabilizers are incorporated into the polypropylene to prevent color degradation resulting from exposure of the playing surface to the elements over a period of time. The density of the tufts may vary depending upon the weight of the multi-filament yarn and the intended use of the playing surface. For the previously mentioned $\frac{3}{8}$ gauge, 5 mil thick polypropylene ribbon yarns, tuft densities ranging from 8 to 24 tufts per square inch are useful. This corresponds to stitch rates from about 3 to about 8 stitches per inch on conventional tufting machines which produce 2 and $\frac{1}{3}$ rows of tufts per inch. The length of the pile elements may range from about $\frac{1}{2}$ to about 2 inches. In most instances, the pile length will be between about 1 and about 2 inches. The tufted piles function to stabilize the top-dressing against shifting and/or erosion and also give color to the playing surface.

The playing surface is top-dressed with a layer of compacted material comprising a mixture of resilient particles and fine sand. Preferably the mixture comprises from 25 to 95 volume percent resilient particles and from 5 to 75 volume percent fine sand. Proportions are expressed in terms of volume percent in order to compensate for the varying densities of different types of resilient particles. Most preferably, the top-dressing comprises from about 50 to about 90 volume percent resilient particles and from about 10 to about 50% fine sand.

A variety of different resilient materials may be used for the resilient particles. One particularly preferred material is granulated cork. Commercially, available cork granules such as used in insulation materials or in the molding of gaskets are generally suitable.

Another particularly preferred resilient material is rubber particles. In addition to natural rubber, synthetic rubbers may be used. Synthetic rubbers such as styrene-butadiene rubber, butyl rubber, cis-polyisoprene rubber, neoprene rubber, nitrile rubber and urethane rubber may be used.

Beads of synthetic polymers not normally considered to be rubbers may also be used. These include the vinyls, e.g., vinyl chloride, vinyl ethers, vinyl acetate etc., the acrylates and methacrylates, polyvinylidene chloride, urethanes, polyamids and polyesters.

Synthetic polymer foam particles are also very advantageous in the top-dressings of the invention. Vinyl foams, e.g., polyvinyl chloride foams, polyvinyl ether foams and the like, foamed polystryene, foamed polyurethanes and foamed polyesters may be used. Of course, foamed natural rubber is also useful. Foams may be either blown foams or whipped foams. Preferred foams have particle densities between about 12 and about 25 pounds per cubic foot.

Indoors or in an arid climate, sponge granules and/or open-celled foam particles may be used as or incorporated into the resilient particles. Such particles may themselves take up and hold moisture and thus, may reduce the need for special moisture modifying materials in some cases.

Plasticizers, antioxidants, antistatic agents and other additives known in the art may, of course, be incorporated in the resilient particles.

Often it is desirable to use a mixture of granules of two or more different resilient materials as the resilient particle components of the top-dressing. For example, a mixture of cork granules and rubber particles formed by shedding rubber tire stock with fine sand makes an excellent top-dressing.

The size of the resilient particles may vary between about 4 and about 70 U.S. screen mesh size. Preferably the resilient particles will lie between about 6 and about 60 U.S. screen mesh size. A range of sizes is preferred to a single uniform size because it is easier to obtain a suitably compacted surface with a range of particle sizes. Fine sand is used in top-dressing the playing surface of the invention because large sand granules tend to be more highly abrasive. Fine sand particles also fill the interstices between the resilient particles thereby forming a more dense compacted top-dressing layer. The sand utilized in the top-dressing of the invention is generally smaller in size than 30 U.S. screen mesh size. Preferably, sand between about 40 and 200 U.S. screen mesh size is used.

The depth of the top-dressing may range between about 50% of the height of the piles and substantially even with the tips of the piles. Preferably, the depth of the top-dressing will lie between about 75% and about 95% of the height of the piles. The projection of the piles above the top-dressing may range from as little as 1/16 inch to as much as ⅜ inch. Most preferably, the projection of the pile elements above the top-dressing will lie between about ⅛ and about ¼ inch.

Optionally, a portion of the resilient particles may be replaced by a moisture modifying material as described in U.S. Pat. No. 4,044,179. A particularly preferred moisture modifying material is vermiculite. Another useful moisture modifying material is calcined clay. The presence of a moisture modifying material is helpful in arid climates, such as the Southwestern United States, to maintain a minimum moisture content in the dressing which enhances cohesiveness of the compacted dressing and prevents excessive dusting. As previously mentioned use of sponge granules or open-celled foam particles in the resilient material may reduce the need for a special moisture modifying material. Use of 10% or more fine sand having a particle size smaller than about 60 U.S. screen mesh size also may reduce or eliminate the need for the moisture modifying material, since the fine sand also tends to hold moisture in the top-dressing layer. In moist climates, such as the Gulf Coast area of the United States, the use of a special moisture modifying material generally will not be necessary. The moisture modifying material may comprise up to 20 volume percent of the top-dressing. In most cases where moisture modifying material is included in the top-dressing, between about 2 and about 16 volume percent will be utilized.

If desired, a small proportion of coloring material may be incorporated in the dressing to enhance the appearance of the playing surface.

The top-dressing functions to stabilize the piles of the pile fabric and prevent graininess. Ordinarily, the pile elements of a pile fabric will have a characteristic grain (i.e., tendency to lay in a given direction related to the direction in which the material passed through the production machinery). The top-dressing counteracts this tendency and prevents the playing surface from having a noticeable grain. The top-dressing also functions to absorb much of the shock of an object impacting on the playing surface and improves the footing of a player running or walking across the surface, particularly when making cuts or sharp turns. The non-abrasive character of the top-dressing and the controlled pile height projecting above the top-dressing make the playing surface of the invention much less likely to produce rug burns or abrasions when players do fall on the surface.

Optionally, the underside of the pile fabric may be provided with a resinous coating which functions to secure the tufts in place, to increase the dimensional stability of the backing and to increase the moisture resistance of the backing. A preferred manner of coating the backing is to contact the back of the pile fabric with a solution of vinyl polymer in a volatile, non-aqueous solvent and then subject the pile fabric to a heat treatment to evaporate the solvent and cure the vinyl polymer coating. Conventional polyvinyl chloride, polyvinyl acetate or natural or synthetic rubber latex coatings can be utilized. The resinous coating is sometimes referred to as a secondary backing. It may also be considered a moisture barrier. Thus, it may be possible to omit moisture barrier 3 if the back of the pile fabric is provided with a suitable resinous coating.

The pile fabric may also be optionally subjected to a heat treatment to induce a slight crimping of free ends of the filaments of the piles. Crimping the pile filaments provides the pile fabric with a firmer, denser, slightly roughened surface which results in a more natural appearance of the final playing surface and also improves the footing for athletes playing on the surface. Crimping the piles may also be resorted to in order to increase the resistance to objects rolling across the playing surface and provide a "slower" playing surface. For polypropylene yarn piles, suitable crimping may be effected by passing the pile fabric through an oven at 285° F. for a period of 10 to 12 minutes. Adjustments to temperature and time may be required depending upon the character of the multi-filament yarn used in the piles and the degree of crimping desired.

The character of the playing surface can be controlled by varying its construction. For example, the shock absorbing character may be increased without giving the surface a springy or spongy feeling by increasing the length of the piles and the depth of the top-dressing. Use of synthetic polymer foam particles in place of rubber shavings will increase the resilience of the surface. Decreasing the projection of the pile elements above the top-dressing will produce a "faster" surface. It is thus possible to tailor the character of the playing surface in order to provide the type of play desired.

Installation of the playing surface according to the invention begins with proper preparation of the subsurface to assure a stable, firm surface which will not shift or settle and which has smooth contours free of waves or ripples. Once the subsurface is prepared, the moisture barrier, if one is to be used, can be put down. The pile fabric is then spread out over the moisture barrier and trimmed as needed. Adjacent sections of the pile fabric must be seamed together. Seaming can suitably be effected either with hot seaming tape or with adhesive and tape. If the character of the subsurface permits, spikes may be driven through the pile fabric and moisture barrier to further stabilize the playing surface against shifting. This may be advisable in areas where stress is repeatedly applied to the playing surface such as near the goal line of a football field. A series of 7 inch spikes arranged at 6 to 18 inch intervals in a zig zag pattern has been found to be helpful. After the pile fabric is in place, the top-dressing is applied with conventional spreading equipment. A mixture of the different particles may be applied simultaneously from a single spreader. However, it is important to guard against segregation of the particles in the hopper of the spreader which can lead to non-uniform application. It is also possible to apply the different particles individually from separate spreaders by passing the spreaders in sequence over the playing surface, the relative proportions of particles being controlled by corresponding adjustment of the spreader outlet openings. Dual unit spreaders with separate hoppers and flow controls for each spreader unit can also be used. During application of the dressing, the piles must be periodically brushed to the upright position as needed. Brushing or sweeping also helps to level out the top-dressing. After application of the top-dressing, the playing surface is ready for use.

EXAMPLE 1

A baseball field is constructed with a tufted pile fabric having grass-like pile elements 1½ inches long laid over the infield and base line areas. The pile fabric is top-dressed with a dressing comprising a mixture of 56% virgin vinyl (polyvinyl chloride) foam beads having a particle size between 10 and 40 U.S. screen mesh, 40% fine sand having a particle size between 40 and 140 U.S. screen mesh and 4% vermiculite having a particle size between 10 and 40 U.S. screen mesh. The depth of the top-dressing is 1 5/16 inches.

EXAMPLE 2

A football field is constructed by laying a pile fabric having grass-like piles 2 inches in length over a firm subsurface and dressing the pile fabric with a mixture of 40 volume percent cork granules having a particle size between 6 and 20 U.S. screen mesh, 35% shredded tire stock having a particle size between 12 and 45 U.S. screen mesh and 25% fine sand having a particle size between 60 and 170 U.S. screen mesh. The depth of the top-dressing is 1¾ inches.

EXAMPLE 3

A soccer field is constructed by laying a pile fabric having grass-like pile elements 1¼ inches long over a stable subsurface and applying a top-dressing comprising 50 volume precent shredded urethane foam particles having a particle size between 6 and 40 U.S. screen mesh size and 50 volume percent fine sand having a particle size between 40 and 200 U.S. screen mesh size over the pile fabric. The depth of the top-dressing is 1 inch.

EXAMPLE 4

Another baseball field is constructed similar to the field of Example 1 except that the top-dressing comprises by volume 20% shredded tire stock, 10% vermiculite, 20% fine sand having a particle size smaller than 60 U.S. screen mesh size, 25% cork granules and 25% virgin vinyl foam. This field is especially adapted to the climate of Southern California.

EXAMPLE 5

Another football field was constructed similar to the field of Example 2 except the top-dressing comprises by volume 25% shredded tire stock, 15% vermiculite, 10% fine sand having a particle size smaller than 60 U.S. screen mesh size, 25% cork granules and 25% virgin vinyl foam. This surface is especially adapted to the climate of the border states.

EXAMPLE 6

Another soccer field is constructed similar to the field of Example 3 except that the top-dressing comprises by volume 10% shredded tire stock, 15% vermiculite, 30% fine sand having a particle size smaller than 60 U.S. screen mesh size, 25% cork granules and 20% virgin vinyl foam. The depth of the top-dressing was 1⅛ inch.

Playing surfaces according to the present invention present a very attractive appearance closely resembling the appearance of natural grass turf. Once installed, the playing surfaces of the invention have a very low maintenance cost because they require very little upkeep. At the same time, the playing surfaces of the invention are much more durable than natural turf or earthen surfaces and can be used for virually continuous play for long periods without exhibiting adverse wear. Playing surfaces of the invention provide outstanding player feel. That is to say, they feel to a player as though they were a natural surface with none of the unnatural springiness or sponginess hitherto characteristic of artificial turf. Furthermore, they are very comfortable and easy on the legs and feet of the player, particularly in comparison with hard pavements. Another advantage is the fact that the characteristics of the playing surface can be readily adjusted according to the type of play desired. Suitable top-dressing materials are readily available. The surfaces of the invention are also much less abrasive than prior top-dressed surfaces.

The foregoing embodiments have been described merely as examples of the invention and are not intended to limit its scope. Since modifications of the described embodiments may occur to persons skilled in the art, the scope of the invention is to be limited solely by the scope of the appended claims.

What is claimed is:

1. A playing surface for athletic games comprising:

(a) a firm, stable subsurface;

(b) a pile fabric having a flexible backing and normally upstanding pile elements resembling grass; the length of said pile elements being substantially uniform and lying in the range from ½ to 2 inches; and (c) a compacted top-dressing layer comprising a mixture of from 25 to 95 volume percent resilient particles and from 5 to 75 volume percent fine sand interspersed among the pile elements and on the backing to a substantially uniform depth at least ½ the length of the pile elements.

2. A playing surface as recited in claim 1, further comprising a moisture barrier layer between the subsurface and the pile fabric.

3. A playing surface according to claim 2, wherein said moisture barrier is a 2 to 10 mil thick polyethylene sheet.

4. A playing surface according to claim 2, wherein said moisture barrier is a layer of 30 to 100 pound weight asbestos roofing felt.

5. A playing surface according to claim 2, wherein said moisture barrier comprises a polymeric coating on the underside of the pile fabric backing.

6. A playing surface according to claim 1, wherein said pile fabric is a tufted pile fabric.

7. A playing surface according to claim 6, wherein the backing of said tufted pile fabric is a woven polypropylene fabric and the tufts are formed from polypropylene ribbons slit and twisted to form a multi-filament yarn; each end of said yarn comprising from 20 to 50 individual pile filaments; the density of said tufts on said backing ranging between 8 and 24 tufts per square inch.

8. A playing surface according to claim 1, wherein said pile fabric is heat treated to slightly crimp the free ends of the pile filaments.

9. A playing surface according to claim 1, wherein the projection of the tips of the piles of the pile fabric above the top-dressing lies in the range from 1/16 to $\frac{3}{8}$ inch.

10. A playing surface according to claim 9, wherein the proejction of the tips of the piles of the pile fabric above the top-dressing lies in the range from $\frac{1}{8}$ to $\frac{1}{4}$ inch.

11. A playing surface according to claim 1, wherein the length of the piles of said pile fabric lies in the range between 1 and 2 inches.

12. A playing surface according to claim 1, wherein the depth of the top-dressing lies between about 75% and about 95% of the length of the pile.

13. A playing surface according to claim 1, wherein said top-dressing comprises from 50 to 90 volume percent resilient particles and from 10 to 50 volume percent fine sand.

14. A playing surface according to claim 1, wherein said resilient particles comprise cork granules.

15. A playing surface according to claim 1, wherein said resilient particles comprise rubber particles.

16. A playing surface according to claim 15, wherein said rubber is natural rubber.

17. A playing surface according to claim 15, wherein said rubber is synthetic rubber selected from the group consisting of styrene-butadiene rubber, butyl rubber, cis-polyisoprene rubber, neoprene rubber, nitrile rubber and urethane rubber.

18. A playing surface according to claim 1, wherein said resilient particles comprise synthetic polymer beads.

19. A playing surface according to claim 1, wherein said resilient particles comprise synthetic polymer foam particles.

20. A playing surface according to claim 19, wherein said synthetic polymer foam is polyvinyl chloride foam.

21. A playing surface according to claim 19, wherein said synthetic polymer foam is urethane foam.

22. A playing surface according to claim 1, wherein said resilient particles comprise a mixture of particles of at least two different resilient materials.

23. A playing surface according to claim 22, wherein said resilient particles comprise a mixture of cork granules and rubber particles.

24. A playing surface according to claim 1, wherein said top-dressing further comprises up to 20 volume percent of a moisture modifier.

25. A playing surface according to claim 24, wherein said moisture modifier is selected from the group consisting of vermiculite and calcined clay.

26. A playing surface according to claim 1, wherein said resilient particles have a particle size between about 4 and about 70 U.S. screen mesh size.

27. A playing surface according to claim 26, wherein said resilient particles have a particle size between about 6 and 60 U.S. screen mesh size.

28. A playing surface according to claim 1, wherein said fine sand has a particle size smaller than about 30 U.S. screen mesh size.

29. A playing surface according to claim 28, wherein said fine sand has a particle size between about 40 and about 200 U.S. screen mesh size.

* * * * *